US009161602B2

(12) United States Patent
Eun

(10) Patent No.: US 9,161,602 B2
(45) Date of Patent: Oct. 20, 2015

(54) DRYER FOR CURLING EYELASHES

(71) Applicant: Marshique, Inc., Ansan-si (KR)

(72) Inventor: Chaejung Eun, Nam-gu (KR)

(73) Assignee: MARSHIQUE, INC., Gyeonggi-Do (KR)

( * ) Notice: Subject to any disclaimer, the term of this patent is extended or adjusted under 35 U.S.C. 154(b) by 0 days.

(21) Appl. No.: 14/352,659

(22) PCT Filed: Oct. 12, 2012

(86) PCT No.: PCT/KR2012/008317

§ 371 (c)(1),
(2) Date: Apr. 17, 2014

(87) PCT Pub. No.: WO2013/058503

PCT Pub. Date: Apr. 25, 2013

(65) Prior Publication Data

US 2014/0251366 A1 Sep. 11, 2014

(30) Foreign Application Priority Data

Oct. 19, 2011 (KR) ..... 20-2011-0009306 U

(51) Int. Cl.
*A45D 2/48* (2006.01)
*A45D 20/10* (2006.01)
*A41G 5/02* (2006.01)

(52) U.S. Cl.
CPC *A45D 2/48* (2013.01); *A45D 20/10* (2013.01); *A41G 5/02* (2013.01)

(58) Field of Classification Search
CPC ..... A45D 2/48; A45D 1/18; A45D 1/16; A45D 20/10; A41G 5/02
USPC ..... 132/217, 218
See application file for complete search history.

(56) References Cited

U.S. PATENT DOCUMENTS

| | | | | |
|---|---|---|---|---|
| 2,444,937 A * | 7/1948 | Marcellus | ..... | 132/217 |
| 2,569,246 A * | 9/1951 | Marcellus | ..... | 132/217 |
| 4,719,931 A | 1/1988 | Suzuki | | |
| 7,637,265 B2 * | 12/2009 | Funatsu et al. | ..... | 132/218 |

FOREIGN PATENT DOCUMENTS

| | | |
|---|---|---|
| JP | 2006-239073 | 9/2006 |
| KR | 20-2009-0012373 | 12/2009 |
| KR | 20-2011-0002647 | 3/2011 |

OTHER PUBLICATIONS

International Search Report for PCT/KR2012/008317 mailed on Feb. 19, 2013 and its English Translation.
Extended European Search Report dated May 21, 2015 from corresponding European Patent Application No. 12841692.2.

* cited by examiner

*Primary Examiner* — Robyn Doan
(74) *Attorney, Agent, or Firm* — Ladas & Parry, LLP

(57) ABSTRACT

The present device relates to a dryer for curling eyelashes. The dryer according to the present device may prevent a user from being burned and also has a novel structure that effectively curls the eyelashes. Since the dryer for curling the eyelashes indirectly heats the eyelashes by using air heated by a heater 20, the dryer may prevent eyes or skin of the user from being burned and may also heat the eyelashes at an adequate temperature to effectively curl the eyelashes.

5 Claims, 6 Drawing Sheets

DRYER FOR CURLING EYELASHES

CROSS-REFERENCE TO RELATED APPLICATIONS

This application is the U.S. National Stage of International Patent Application No. PCT/KR2012/008317 filed on Oct. 12, 2012, which claims priority to Korean Patent Application No. 20-2011-0009306 filed on Oct. 19, 2011, the disclosures of which are hereby incorporated by reference in their entireties.

TECHNICAL FIELD

The present invention relates to a dryer for curling eyelashes that is capable of effectively curling the eyelashes with no risk of the users' getting burnt.

BACKGROUND OF THE INVENTION

Lately, a variety of eyelash curlers, mechanical or electronic, are widely being used among women in their efforts to make their eyelashes look long, dark and thick.

The existing mechanical eyelash curlers are made with forming frames so that the eyelashes are curled by giving strong pressure to them. The electronic curlers have an electric heating device exposed on one side of a brush which push the eyelashes upward, while a heater heats up and curls them.

However, in case of the mechanical eyelash curlers, it is difficult to form the eyelashes in the way we want and it doesn't last long as well. In addition, there is another problem that the curlers often pull out some of the eyelashes while in use.

Also, the electronic eyelash curlers have the heater installed to be exposed along the small-sized brush, which often makes it hard to control the heat, and sometimes the heater can heat up to 100° C. and burn the users, which is highly problematic.

Moreover, since the electronic curlers function with the high temperature heaters getting in touch with the eyelashes, they can burn or damage the eyelashes as well.

On the other hand, the eyelashes can be curled up alright at the temperature below 50° C.

DISCLOSURE

Technical Problem

This present invention is made to solve the problems described above. An object of the present invention is to provide a dryer for curling eyelashes that is capable of effectively curling the eyelashes with no risk of the users' getting burnt.

The object and many advantages of the present invention will be made more clearly by those skilled in the art from the embodiments of the present invention.

Technical Solution

In accordance with an aspect of the embodiment of the present invention, there is provided a dryer for curling eyelashes, which includes a case 10, a heater 20 and a fan 30 provided within the case 10; and a curling unit 40 provided at the fore-end of the case 10 and configured to curl eyelashes, wherein the heater 20 is installed apart from the curling unit 40 so that the air heated by the heater heats up the curling unit 40 or the eyelashes, thereby curling the eyelashes.

According to another feature of the embodiment, the case 10 includes a suction port 14 formed on one side of the case, an elongated exhaust port 15 formed on one side of the upper part of the fore-end of the case, and the curling unit 40 is attached at the fore-end part of the case 10 so that it is located on one side of the exhaust port 15 or on one side of the exhaust port 15.

According to another feature of the embodiment, the curling unit 40 has a plurality of bristle elements 42 arranged the top part thereof.

According to another feature of the embodiment, the curling unit includes a metallic heat absorbing member 43 that has high conductivity, and the top and bottom sides of the heat absorbing member 43 are exposed to the above and below side of the curling unit 40.

According to another feature of the embodiment, the curling unit 40 is the same as the upper exhaust port 15 in its shape and is configured to block the exhaust port 15, and the curling unit 40 has a plurality of pass-through holes 45 through which the heated air passes to heat up the heat absorbing member 43.

According to other feature of the embodiment, the curling unit 40 is composed of several forms and is removably attached to the case 10, which allows its replacement for another curling unit 40 for its intended use.

Advantageous Effects

The inventive eyelash curling dryer makes use of the heated air by the heater 20 to indirectly heat the eyelashes, whereby preventing the eyes or the skin from being heated, as well as it can effectively curl the eyelashes at just the right temperature.

BEST MODE FOR THE INVENTION

Figure 1:
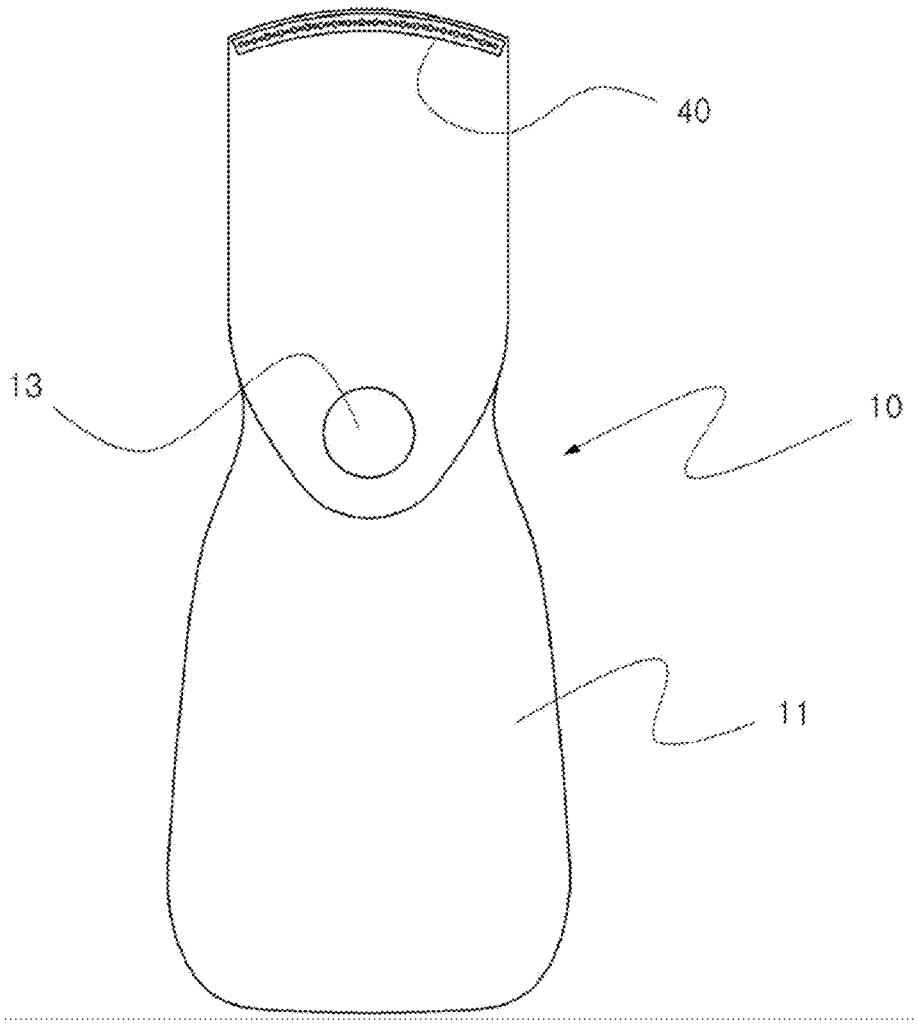
FIG. 1 is a plan view to show a dryer for curling eyelashes in accordance with the present invention.
Figure 2:
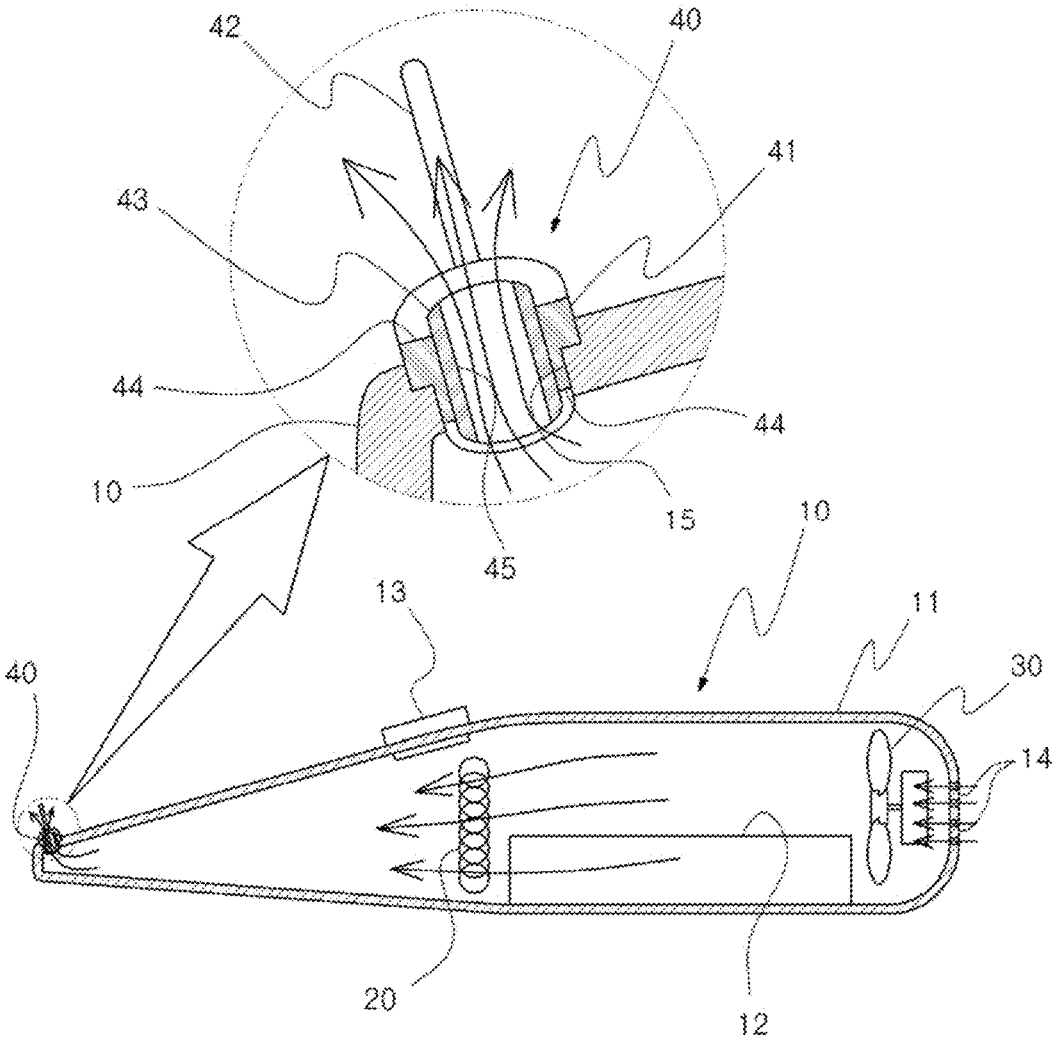
FIG. 2 is a sectional view to show a dryer for curling eyelashes in accordance with the present invention.
Figure 3:
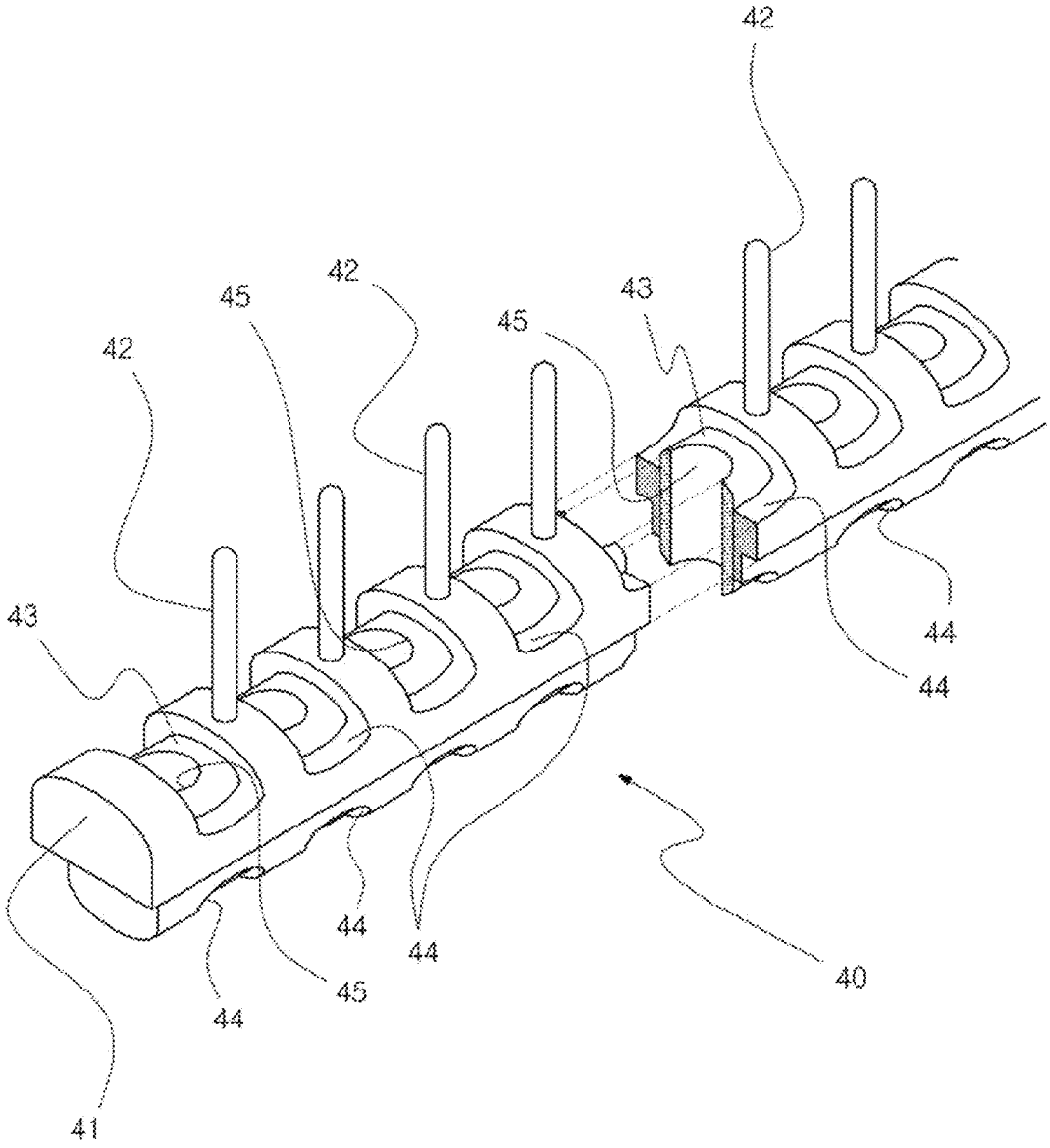
FIG. 3 is a partially sectional perspective view to show a curling unit of a dryer for curling eyelashes in accordance with the present invention.
Figure 4:
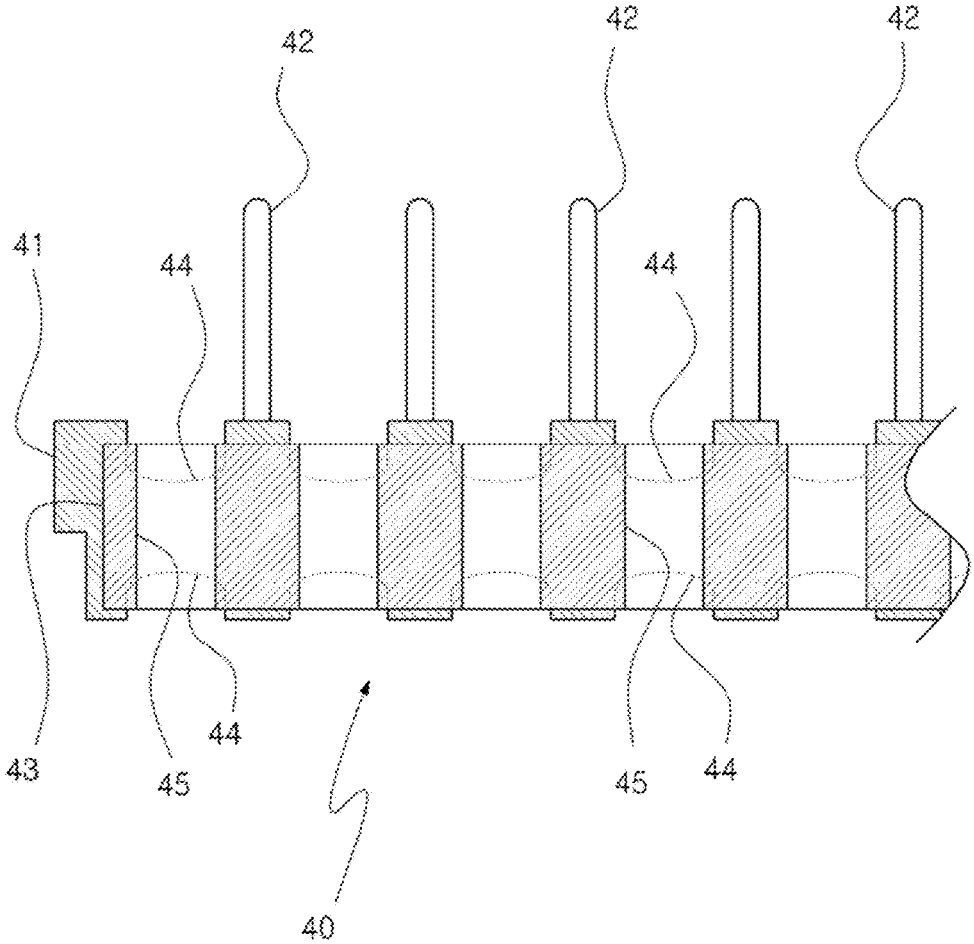
FIG. 4 is a front sectional view to show a dryer for curling eyelashes in accordance with the present invention.
Figure 5:
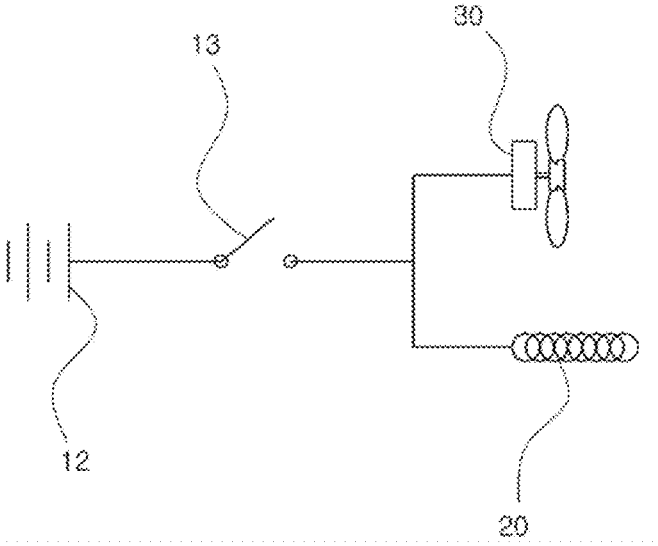
FIG. 5 is a configuration diagram to show a dryer for curling eyelashes in accordance with the present invention.

Hereinafter, the present invention will be described in detail with reference to accompanying drawings.

FIGS. 1 to 6 illustrate a dryer for curling eyelashes which includes a case 10, a heater 20 and a fan 30 provided within the case 10, a curling unit 40 provided at the fore-end of the case 10 curls an eyelashes 1, wherein the heater 20 is installed apart from the curling unit 40, which heats up the air that in turn heats up the curling unit 40 or the eyelashes 1 to be curled.

To explain in further details, the case 10 is configured in an elongated form in the direction of front and back. A handle 11 is formed at the proximal end of the case, which is easy to grasp by hand, with a circular or elliptical shape in section, and the fore-end of the case is shaped broad horizontally, and narrow vertically.

Within the handle 11, a battery 12 is inserted and installed, providing the electricity to the heater 20 and the fan 30, and on the top center part of the case 10, a power switch 13 is provided to control the operation of the heater 20 and the fan 30.

Also, a suction port 14 is formed at the back end of the case 10, and an elongated exhaust port 15 is formed on the upper part of the fore-end of the case, which corresponds with the elongated shape of the eyelashes 1 with its central part protruding like an arc.

The heater 20 is installed between the suction port 14 and the exhaust port 15, so that it is separated from the curling unit 40.

The fan 30 is installed adjacent to the suction port 14, so that the outside air can be drawn forced into the suction port 14, passing through the heater 20, and can exhaust through the exhaust port 15, thereby heating up the curling unit 40 and the eyelashes 1.

The heater 20 and the fan 30 may be made so that they can heat the air below 50° C.

The curling unit 40 includes a support 41 that gets attached to the exhaust port 15 and a plurality of bristle elements 42 that extend upward from the top part of the support 41, which is composed of the synthetic resins that are of high strength and of heat resistant material.

The support 41 is elongated sideways with the central part protruding like an arc and has a metallic heat-absorbing member 43 therein that has high heat conductivity. On the top and bottom surfaces of the support 41, there are plural exposed parts 44 that expose the heat absorbing member 43 by severing the portions of the top and bottom surfaces of the support 41. The exposed parts 44 are located between the bristle elements 42 and are configured to get in touch with the top part of the heat absorbing member 43 through the exposed parts 44 when rising up the eyelashes 1 using the bristle elements 42.

Also, the support 41 and the exhaust port 15 are of the same size, so that, when combined, the exhaust port 15 is blocked and closed. Further, the support 41 has a plurality of pass-through holes 45 that are formed to pass through the top and bottom surfaces, so that the air inside the case 10 passes through the pass-through holes 45 to exhaust above the upper surface of the case 10. The pass-through holes 45 are formed to go through the heat absorbing member 43 upwardly and downwardly so as for the top and bottom sides of the heat absorbing member 43 to be exposed to the exposed parts 44.

The brush elements 42 are thin and short in length, shaped like the eyelashes, separated sideways from one other with a preset gap, thereby allowing the curling unit 40 to curl up the eyelashes 1 with the help of the brush elements 42.

The curling unit 40 has a top surface configured to protrude upward from the top surface of the case 10, so that the fore-end of the case 10 can avoid the eyes or other part of the face when pushing the eyelashes upward with the brush elements 42.

Therefore, if the appropriate curling unit 40 is combined with the exhaust port 15 and the heater 20 and the fan 30 are operated, the air heated up by the heater 20 exhausts outside through the pass-through holes 45, thereby heating up the heat absorbing member 43 of the support 41.

Figure 6:
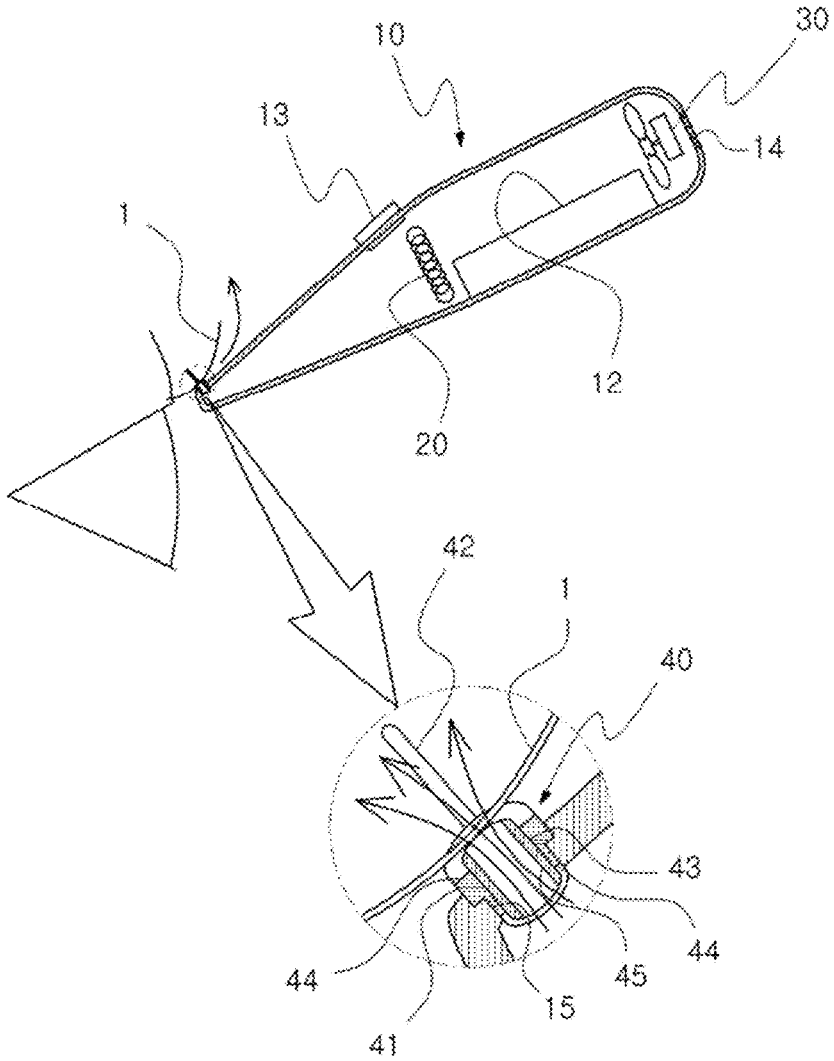
FIG. 6 is a reference view to show a use state of a dryer for curling eyelashes in accordance with the present invention.

As illustrated in FIG. 6, if the eyelashes are pushed upward for curling using the brush elements 42 of the curling unit 40, they are closely attached to the heat absorbing member 43 and get heated and curled by the heat from the heat absorbing member 43 and the air that exhausts outside through the holes 45.

As mentioned above, the designed dryer of the embodiment of the present invention, unlike the existing electronic curler whose heater 20 gets exposed to the outside, has the heater 20 installed inside the case 10, which indirectly heats up the eyelashes 1 through the medium of the air, whereby avoiding the potential damages of either burning the eyelashes or the eyes or the skin, as well as effectively curling the eyelashes at the appropriate temperature.

Especially, the exhaust port 15 is formed on the top surface of the case 10 and the hot air exhausts only to the upper part, which effectively prevents the hot air blowing toward the eyes to dry or burn them.

Further, the curling unit 40 has the brush elements 42 that are thin and short in length, which can be useful to turn up the eyelashes 1 to curl and to organize them at the same time when pushing upward the eyelashes.

Furthermore, the curling unit 40 has a plurality of pass-through holes 45 installed at the exhaust port 15, through which the hot air heats up the curling unit 40, which effectively heats the eyelashes 1.

Especially, the curling unit 40 has the metallic heat-absorbing member 43, installed exposed vertically, get heated up by the air exhaust through the pass-through holes 45, which allows the eyelashes to get heated up fast by getting in touch with them.

While the embodiment has been describe and shown the case 10 in the elongated shape, the case 10 may be modified in various shapes.

Also, although the curling unit 40 is exemplified as a combined form with the exhaust port 15, they may be modified in various shapes, such as the horizontally long one without the brush elements 42 or one without the heat absorbing member 43, so that the users can choose the appropriate one for their intended use and use it combined to the exhaust port 15.

Also, although the curling unit 40 is exemplified as blocking the exhaust port 15, the support 41 of the curling unit 40 may be made smaller in size than the exhaust port 15 so that hot air will be exhausted around the support 41.

Description of the present invention as mentioned above is intended for illustrative purposes, and it will be understood to those having ordinary skill in the art that this invention can be easily modified and changed without changing the technical gist of the present invention.

The invention claimed is:

1. A dryer for curling eyelashes comprising:

a case, a heater and a fan provided within the case; and a curling unit provided at the fore-end of the case and configured to curl eyelashes, wherein the heater is installed apart from the curling unit so that the air heated by the heater heats up the curling unit or the eyelashes, thereby curling the eyelashes, wherein the case includes a suction port formed on one side of the case, and an elongated exhaust port formed on one side of the upper part of the fore-end of the case, wherein the curling unit includes a metallic heat absorbing member that has high conductivity, and wherein the curling unit is the same as the exhaust port in its shape and is configured to block the exhaust port, and the curling unit has a plurality of pass-through holes through which the heated air passes to heat up the heat absorbing member.

2. The dryer of claim 1, wherein the curling unit is attached at the fore-end part of the case so that it is located on one side of the exhaust port or on one side of the exhaust port.

3. The dryer of claim 1, wherein the curling unit has a plurality of bristle elements arranged the top part thereof.

4. The dryer of claim 1, wherein the top and bottom sides of the heat absorbing member are exposed to the above and below side of the curling unit.

5. The dryer of claim 1, wherein the curling unit is composed of several forms and is removably attached to the case, which allows its replacement for another curling unit for its intended use.

* * * * *